US005971087A

United States Patent [19]

Chaves

[11] Patent Number: 5,971,087

[45] Date of Patent: Oct. 26, 1999

[54] REDUCED RESIDUAL TENSILE STRESS SUPERABRASIVE CUTTERS FOR EARTH BORING AND DRILL BITS SO EQUIPPED

[75] Inventor: Arthur A. Chaves, Sandy, Utah

[73] Assignee: Baker Hughes Incorporated, Houston, Tex.

[21] Appl. No.: 09/082,221

[22] Filed: May 20, 1998

[51] Int. Cl.[6] ..... E21B 10/36; B23F 21/03

[52] U.S. Cl. ..... 175/432; 175/426; 175/430; 451/540; 451/541; 51/293

[58] Field of Search ..... 175/410, 430, 175/431, 432, 426; 451/540, 541, 542; 407/118, 119; 51/307, 309, 293, 295

[56] References Cited

U.S. PATENT DOCUMENTS

| | | | |
|---|---|---|---|
| 3,605,923 | 9/1971 | Feenstra . | |
| 4,109,737 | 8/1978 | Bovenkerk . | |
| 4,478,298 | 10/1984 | Hake et al. | 175/410 X |
| 4,713,286 | 12/1987 | Bunting et al. | 51/309 X |
| 4,861,350 | 8/1989 | Phaal et al. | 175/410 X |
| 4,954,139 | 9/1990 | Cerutti . | |
| 5,007,207 | 4/1991 | Phaal . | |
| 5,011,515 | 4/1991 | Frushour . | |
| 5,120,327 | 6/1992 | Dennis | 51/293 |
| 5,271,696 | 12/1993 | Stock . | |
| 5,351,772 | 10/1994 | Smith | 175/428 |
| 5,355,969 | 10/1994 | Hardy et al. . | |
| 5,435,403 | 7/1995 | Tibbitts | 175/432 |
| 5,467,836 | 11/1995 | Grimes et al. | 175/426 X |
| 5,472,376 | 12/1995 | Olmstead et al. | 175/432 X |
| 5,486,137 | 1/1996 | Flood et al. . | |
| 5,494,477 | 2/1996 | Flood et al. . | |
| 5,566,779 | 10/1996 | Dennis . | |
| 5,590,728 | 1/1997 | Matthias et al. . | |
| 5,605,199 | 2/1997 | Newton . | |
| 5,647,449 | 7/1997 | Dennis . | |
| 5,706,906 | 1/1998 | Murewicz et al. | 175/430 X |
| 5,711,702 | 1/1998 | Devlin | 175/432 X |
| 5,743,346 | 4/1998 | Flood et al. . | |
| 5,833,021 | 11/1998 | Mensa-Wilmot et al. . | |

FOREIGN PATENT DOCUMENTS

| | | |
|---|---|---|
| 0 214 795 A1 | 3/1987 | European Pat. Off. . |
| 0 687 797 A1 | 12/1995 | European Pat. Off. . |

OTHER PUBLICATIONS

The New DPI Premium PDC Cutters, EDGE™ CUTTERS, DPI/Diamond Products International (no date) (1 page).

*Primary Examiner*—David Bagnell
*Assistant Examiner*—Jong-Suk Lee
*Attorney, Agent, or Firm*—Trask, Britt & Rossa

[57] ABSTRACT

A superabrasive cutting element, the substrate of which is structured with a reduced dimension circumferential portion about which is formed an annular portion of superabrasive material, such as sintered diamond in the form of a polycrystalline diamond compact, to provide a ring- or skirt-like portion of superabrasive material at the perimeter of the cutting element to reduce residual tensile stresses existing at the perimeter of the cutting element after formation.

20 Claims, 5 Drawing Sheets

REDUCED RESIDUAL TENSILE STRESS SUPERABRASIVE CUTTERS FOR EARTH BORING AND DRILL BITS SO EQUIPPED

BACKGROUND OF THE INVENTION

1. Field of the Invention

The present invention relates to superabrasive cutting elements used in drill bits to perform earth boring, and specifically relates to superabrasive cutting elements which are structured to reduce residual tensile stresses proximate the cutting edge perimeter of the cutting element.

2. Description of Related Art

Superabrasive cutting elements are manufactured for placement in drill bits which are used for drilling or boring earth formations. The majority of superabrasive cutting elements comprise a portion of superabrasive material which is positioned to contact the earth formation for cutting, and a substrate member to support the superabrasive portion and provide structure for attachment of the cutting element to the drill bit. The superabrasive portion is typically a "table" comprised of a polycrystalline diamond compact (PDC) or other suitable material, such as cubic boron nitride, and the substrate is often formed from a material such as cemented tungsten carbide or other suitable material compatible with the superabrasive portion.

The configuration of cutting elements varies widely and the patent literature is replete with examples of various cutting element designs. The variety in configurations of cutting elements is principally directed by a desire or need to form a structurally stronger, tougher and more wear-resistance and fracture-resistant element. It is well-known, for example, that superabrasive cutting elements can fail or may have limited service life due to stress fractures, which manifest themselves in fracture, spalling and micro-chipping of the superabrasive table. Drilling in hard rock or shale formations, or formations with hard rock stringers, is especially damaging. It is known that the tendency toward such stress fractures or failures is caused by the fact that the materials comprising the superabrasive portion, or diamond table, and the substrate have different coefficients of thermal expansion, elastic moduli and bulk compressibilities. After formation of cutting elements by the known high temperature and high pressure techniques, the table and substrate materials subsequently shrink at different rates during cooling, resulting in internal residual stresses in the superabrasive table, notably in the vicinity of the interface between the table and substrate. Consequently, the diamond table material tends to be in residually stressed compression while the substrate material tends to be in residually stressed tension prior to being subjected to cutting loads experienced during drilling operations. Fracturing of the cutting element may result at the cutting edge, whether on the table, at the perimeter of the cutting edge or near the interface between the diamond table and the substrate. Further, such residual stresses in the cutting element may provoke delamination of the table from the substrate or delamination in the table itself under the extreme temperatures and pressures of drilling.

Various solutions have been suggested in the art for modifying the internal residual stresses in cutting elements to avoid or limit the described failures. Hence, the configuration of the cutting element may be designed to address the residual stress problem. Cooperative table and substrate configurations which purport to address the issue of cutting element failure are disclosed, for example, in U.S. Pat. No. 5,007,207 to Phaal; U.S. Pat. No. 5,120,327 to Dennis; U.S. Pat. No. 5,355,969 to Hardy, et al.; U.S. Pat. No. 5,494,477 to Flood, et al.; U.S. Pat. No. 5,566,779 to Dennis; U.S. Pat. No. 5,605,199 to Newton; EP 0322214 issued to De Beers Industrial Diamond; EP 0214795 issued to De Beers Industrial Diamond and EP 0687797 issued to Camco Drilling Group.

The cutting element configurations disclosed in the prior art have demonstrated varying degrees of success in modifying the stress states in the cutting element. It would be advantageous, however, to provide a cutting element configuration which further improves upon the reduction of residual tensile stresses in the superabrasive layer of the cutting element, particularly on the cutting face and in the area near the perimeter of the cutting edge.

BRIEF SUMMARY OF THE INVENTION

In accordance with the present invention, the substrate of a superabrasive cutting element is specifically structured with a reduced dimension circumferential portion adjacent the table/substrate interface about which is located an annular ring or skirt of superabrasive material to substantially reduce tensile stresses in the superabrasive portion of the cutting element near the perimeter of the cutting edge and on the cutting face. The substrate of the superabrasive cutting element may also be structured to provide interior annular grooves filled with superabrasive material, thereby further modifying the tensile stresses in the superabrasive table. Because the coefficient of thermal expansion (COTE) of the substrate material is typically higher than the coefficient of thermal expansion of the superabrasive material and, in combination, the different COTE values are responsible for a significant portion of the residual tensile stresses in conventional cutting elements, the reduced dimension circumferential portion of the substrate adjacent the interface beneficially modifies the residual tensile stresses which occur in the superabrasive portion. The proposed mechanism for the reduction of tensile stress in the present invention is twofold: 1) the reduced volume of substrate which has less ability to pull the diamond or superabrasive table, and 2) the relative locations of the outside superabrasive ring and inner carbide material. Additionally, the portion of superabrasive material positioned about the perimeter of the cutting element enhances the modification of residual stresses in the superabrasive portion near the perimeter of the cutting edge. The configuration of the cutting element of the present invention facilitates reduced residual tensile stresses in the superabrasive member near the perimeter of the cutting element and on its cutting face, thereby increasing the ability of the cutting element to withstand higher loading conditions compared to other known configurations.

In a first embodiment of the invention, the substrate is formed with a reduced dimension circumferential portion which provides a substantially cylindrical profile in the substrate about which an annular portion of superabrasive material is formed. The annular portion of superabrasive material is part of the superabrasive table of the cutting element and extends downwardly from an upper superabrasive layer which contacts the top surface of the substrate. The upper superabrasive layer and annular portion are preferably formed from the same type and grade of superabrasive material, but may comprise different types and grades of material. Finite element analyses show that the distance to which the annular portion is selected to extend downwardly from the upper superabrasive layer of the superabrasive portion or, in other words, the height of the reduced dimension circumferential portion, determines the amount to which the residual stresses near the perimeter of the superabrasive portion are reduced. Generally, reduction of residual tensile stresses is greatest in the particular instance of a configuration of this embodiment, given the thickness of the superabrasive table and superabrasive ring, when the annular portion extends below the upper superabrasive layer a distance of between about 0.030 inches and about 0.060 inches. The distance to which the annular portion extends below the upper superabrasive layer will generally increase as the height or depth of the cutting element increases in order to optimize reductions in tensile stress at the perimeter.

In additional embodiments of the cutting element described heretofore, one or more annular grooves may be formed in the top surface of the substrate within the bounds of, and in proximity to, the outer edge of the reduced dimension circumferential portion. Superabrasive material extends into the annular grooves during the process of forming the cutting element. The resulting rings of superabrasive material positioned in the top surface of the substrate again reduce the volume of substrate material, which adds to the reduction of residual tensile stresses in the superabrasive portion. The annular grooves formed in the substrate may be of substantially equal depth to each other, but the rings of superabrasive material extending into the substrate do not extend as far from the upper superabrasive layer, or the table/substrate interface, as does the outlying annular portion. Alternatively, the depth of the annular grooves in the substrate may be unequal, with relatively deeper annular grooves being preferably positioned toward the outer edge of the reduced dimension circumferential portion to provide additional superabrasive material near the perimeter.

In another embodiment of the invention, the reduced dimension circumferential portion of the substrate may be frustoconically-shaped with an annular or skirt portion of superabrasive material positioned thereabout. The superabrasive table is preferably manufactured in a similarly frustoconically-shaped outer perimeter profile at the cutting edge of the cutting element. The reduced dimension circumferential portion of the substrate may be modified even further to provide elements of a cylindrical outer profile or frustoconically-shaped profile, or both.

In another embodiment, the top surface of the substrate is configured to extend radially outwardly and downwardly from the center line of the cutting element to slope toward the outer perimeter surface of the substrate. At a point defined by the intersection of the sloped top surface of the substrate with a line formed through the cylindrical outer perimeter edge of the cutting element at about a 45° angle to the outer perimeter surface of the substrate, the reduced dimension circumferential portion of the substrate begins and extends downwardly at an angle toward the outer perimeter surface of the substrate. The reduced dimension circumferential portion of the cutting element, therefore, presents a sloping face against which the annular portion of the superabrasive material is positioned. Finite element analysis shows that the sloped upper surface and sloping face of the substrate effectively modify and reduce the residual tensile stresses near the perimeter of the cutting edge of the cutting element and near the superabrasive/substrate interface.

The cutting elements disclosed herein may be made using any conventional high temperature, high pressure (HTHP) processing to form the superabrasive material to the substrate. The substrate may also be preformed or configured by any suitable conventional means, such as sintering or hot isostatic pressing.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

Figure 1:
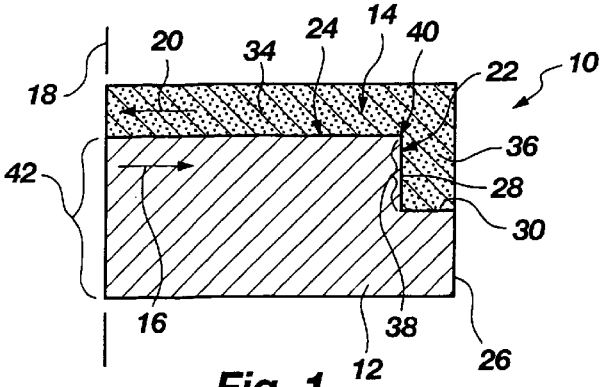
FIG. 1 is a longitudinal cross section of one half of a cutting element of the present invention, as taken through line 1—1 of FIG. 2.
Figure 2:
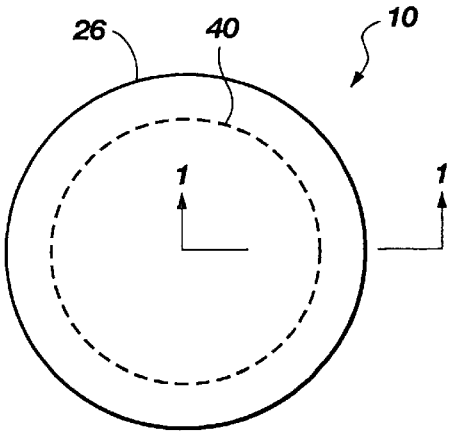
FIG. 2 is a plan view of the embodiment illustrated in FIG. 1 showing in phantom the outer edge of the reduced dimension circumferential portion of the substrate.

FIG. 1 illustrates the cutting element 10 of the present invention in a first embodiment where only half of the cutting element is shown, but it is understood that the other half of the cutting element not shown is a mirror image of the half which is illustrated. The cutting element 10 of the present invention generally comprises a substrate 12 which provides a supporting body for a superabrasive table 14. The substrate 12 may be made of any number of suitably hard materials, or combination of materials, such as tungsten carbide, cobalt, nickel, and nickel- or cobalt-based superalloys. The superabrasive table 14 may be formed of any suitable superabrasive material which is compatible with the substrate and which is suitable for the intended drilling application, but a particularly suitable material may be polycrystalline diamond in the form of a polycrystalline diamond compact, or PDC. In the context of this disclosure, the term "diamond table" may be used interchangeably with the term (superabrasive table).

It has been demonstrated that during the manufacture of cutting elements, the coefficient of thermal expansion tends to be different between the material of the substrate 12 and the material of the superabrasive table 14 such that the substrate 12 is pulled radially outwardly, in the direction of arrow 16, as the cutting element cools. Conversely, the superabrasive table 14 is pulled inwardly toward the center axis 18 of the cutting element 10, in the direction of arrow 20, as the cutting element 10 cools. Thus, in the region near the central axis 18, the table 14 tends to be in compression while the substrate 12 tends to be in tension. When the superabrasive table 14 is a simple flattened disk which overlays the substrate 12, as is commonly described in the art and illustrated in FIG. 16, the stress exerted by the cooling substrate 12 proximate the table/substrate interface can result in residual tensile stresses in the superabrasive table 14 at points A and B near its perimeter of the cutting edge. These residual stresses can lead to stress fractures exhibited as spalling and micro-chipping in the area of the cutting face and perimeter of the cutting element 10.

It has been shown by the inventor through finite element analysis that if the substrate 12 is reduced in circumference near the superabrasive table 14, less tensile stress is exerted near the perimeter on the superabrasive table 14. Further, it has been shown that if the superabrasive table 14 is extended to form a substantial ring or skirt about the reduced dimension circumferential portion of the substrate 12, then stresses on the superabrasive table 14 exerted by the substrate 12 after cooling are modified.

Therefore, FIG. 1 illustrates a first embodiment of the present invention where the cutting element 10 is cylindrical in shape and where substrate 12 is structured with a reduced dimension circumferential portion 22 near the top surface 24 of the substrate 12 as compared to the outer circumferential or perimeter surface 26 of the substrate 12. The reduced dimension circumferential portion 22 may be formed, as illustrated, by providing an inner circumferential wall 28, which is substantially parallel to the outer perimeter surface 26 of the substrate 12, and a shoulder 30 formed substantially perpendicular to the outer perimeter surface 26 of the substrate 12. Shoulder 30 need not be strictly perpendicular to the outer perimeter surface 26, however. During one exemplary technique forming the cutting element 10, the substrate 12 is positioned in a cartridge and superabrasive material, in the form of a grit, is placed over the substrate 12. When subjected to HTHP processing, superabrasive material (i.e., grit) contacting the top surface 24 of the substrate 12 is pressed to form an upper superabrasive layer 34 of the superabrasive table 14, and the grit which fills the void left by the reduced dimension circumferential portion 22 is pressed to form an annular portion 36 of the superabrasive table 14.

Figure 16:
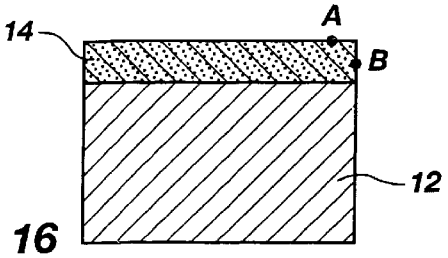
FIG. 16 is a longitudinal cross section of a conventional cutting element of the prior art having a diamond table formed as a flattened disk.
Figure 10:
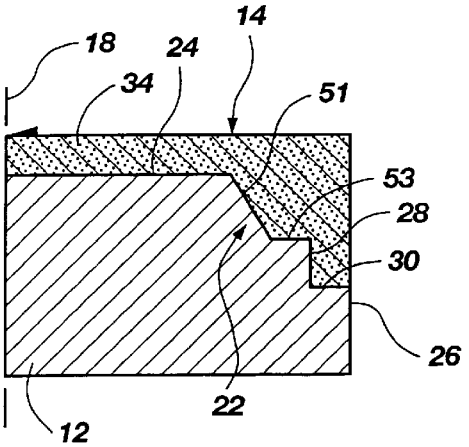
FIG. 10 is a longitudinal cross section of an eighth embodiment of the cutting element of the present invention where the substrate is manufactured with a combined frustoconical and cylindrical profile.

Finite element analyses reveal that the reduction of residual tensile stresses in the superabrasive table 14 is affected by the distance to which the annular portion 36 of superabrasive material extends downwardly from the upper superabrasive layer 34 or, in other words, extends downwardly from a plane formed through the top surface 24 of the substrate 12. The distance may otherwise be defined as the distance 38 of the inner circumferential wall 28 defined between the outer edge 40 of the top surface 24 of the substrate 12 and the shoulder 30. FIG. 10 illustrates this phenomenon by showing that a conventional superabrasive cutting element having only a planar superabrasive table (with no annular ring), as shown in FIG. 16, demonstrates maximum residual tensile stresses at about 24,000 psi in the table and about 22,000 psi near the perimeter of the cutting edge of the cutting element. The presence of an annular portion 36, and particularly one having a distance 38 or depth of between about 0.03 inches and about 0.06 inches, demonstrates about a seventy-five percent reduction in residual stresses in the superabrasive table 14 and about a seventy-five percent reduction in residual stresses in the annular portion or 36. Notably, the optimum depth 38 of the annular portion 36 will generally increase with an increase in the height or depth of the cutting element.

Figure 4:
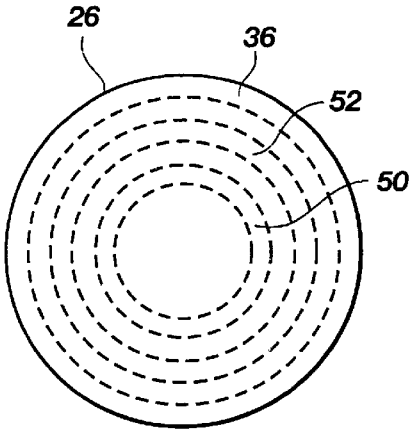
FIG. 4 is a plan view of the embodiment illustrated in FIG. 3 showing in phantom the outer edge of the reduced dimension circumferential portion of the substrate and the annular grooves formed in the substrate.
Figure 3:
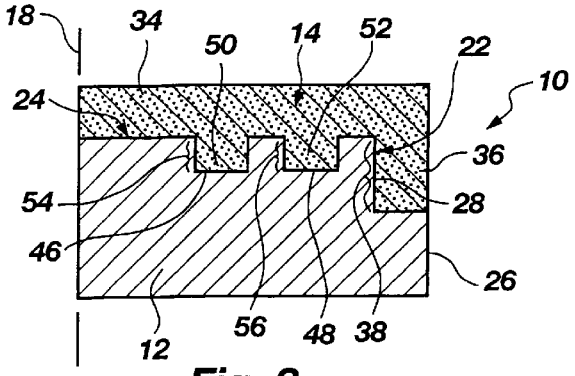
FIG. 3 is a longitudinal cross section of one half of a second embodiment of a cutting element of the present invention.

In a second embodiment of the present invention shown in FIG. 3, the reduction in tensile stress manifest by providing a reduced dimension circumferential portion 22 is further enhanced by structuring the substrate 12 with one or more annular grooves 46, 48 formed in the top surface 24 of the substrate 12 at a distance from the center axis 18 of the substrate element 10 and preferably toward the outer perimeter surface 26 of the cutting element 10. A plan view of the annular grooves 50, 52 and their proximity to the outer perimeter surface 26 of the cutting element 10 is illustrated in FIG. 4. During formation of the cutting element 10, abrasive material in the form of grit is placed on top of the substrate 12 and is pressed under HTBP techniques into the annular grooves 46, 48 formed in the substrate 12 to produce grooves 50, 52 or rings of superabrasive material further comprising the superabrasive table 14. Thus, when the cutting element is cooling, or has cooled, after manufacture, the stresses in the superabrasive table 14 are modified because of a reduction in the volume of substrate material near the interface with the superabrasive table 14 and because of the correct juxtaposition of the outer superabrasive material adjacent the inner substrate and the repetition thereof. The stresses existing in the substrate 12 are also beneficially modified by the grooves 50, 52 of superabrasive material and the annular portion 36 of the superabrasive table 14.

Figure 5:
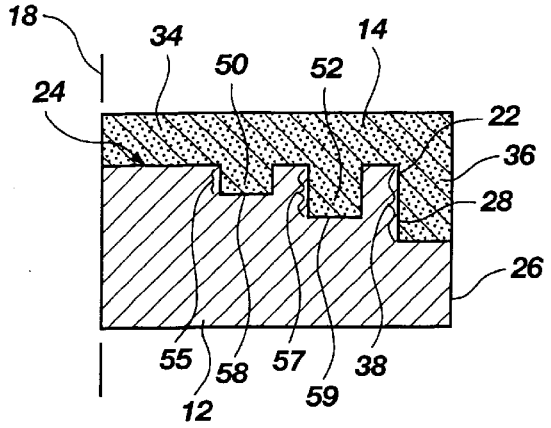
FIG. 5 is a longitudinal cross section of one half of a third embodiment of the cutting element of the present invention where the annular grooves in the substrate are of different depths.

As shown in FIG. 3, the longitudinal depth 54, 56 of the annular grooves 50, 52, respectively, may be substantially equal to each other, but are preferably of lesser longitudinal depth dimension than the inner circumferential wall 28 of the reduced dimension circumferential portion 22. Alternatively, as shown in FIG. 5, which illustrates a third embodiment of the invention, the relative longitudinal depths 55, 57, respectively, of the annular grooves 58, 59 formed in the top surface 24 of the substrate 12 may vary from each other. Preferably, the longitudinal depth 57 of the outermost annular groove 59 is greater than the depth 55 of the innermost annular groove 58 to position more superabrasive material toward the perimeter of the cutting element. The outermost annular groove 59 may or may not be substantially equal to the depth 38 of the inner circumferential wall 28 of the reduced dimension circumferential portion 22 of the substrate 12. FIG. 5 illustrates one exemplar embodiment where the longitudinal depth 57 of the outermost annular groove 59 is less than the depth 38 of the inner circumferential wall 28.

Figure 6:
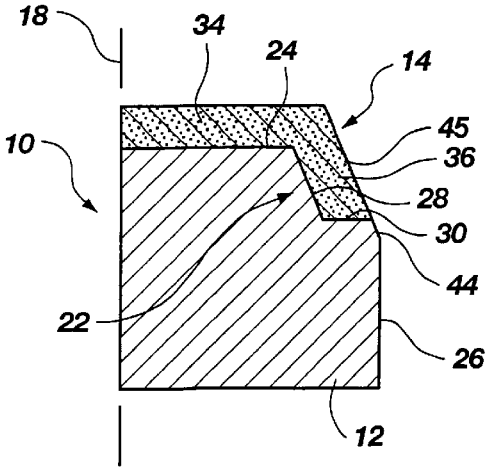
FIG. 6 is a longitudinal cross section of one half of a fourth embodiment of the cutting element of the present invention having a sloped superabrasive member.

FIG. 6 illustrates a fourth embodiment of the cutting element of the present invention where the reduced dimension circumferential portion 22 is formed with an inner circumferential wall 28 which is configured to slope outwardly from the top surface 24 of the substrate 12 toward the outer perimeter surface 26 of the substrate 12 to a point where it intersects with a shoulder 30 formed at a generally perpendicular angle to the outer perimeter surface 26 of the substrate 12. The substrate 12 of the embodiment illustrated in FIG. 6 is further configured with an inwardly angled perimeter rim 44 above which the shoulder 30 is positioned to form the reduced dimension circumferential portion 22. In an exemplary manufacture of the cutting element 10, superabrasive material (e.g., diamond grit) is positioned on the particularly configured substrate and a frustoconically-shaped spacer is positioned over the superabrasive material to form, under HTHP processing, a superabrasive table 14 having an upper superabrasive layer 34 positioned along the top surface 24 of the substrate and an annular portion 36 positioned about the reduced dimension circumferential portion 22. The superabrasive table 14 is additionally shaped with an outer sloping perimeter surface 45 which joins the perimeter rim 44 of the substrate 12 to provide a single-plane surface.

Figure 7:
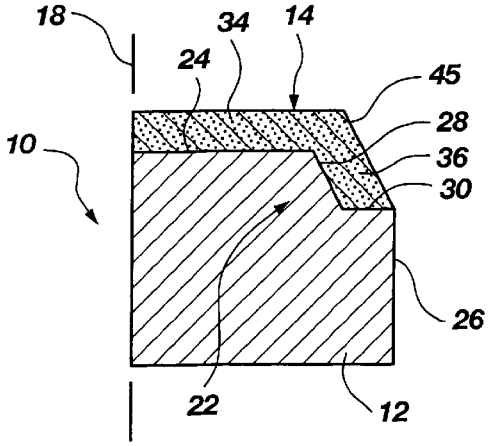
FIG. 7 is a longitudinal cross section of one half of a fifth embodiment of the cutting element of the present invention having a sloped superabrasive member.

FIG. 7 illustrates a fifth embodiment of the cutting element 10 of the present invention in which the shoulder 30 is formed to project inwardly from, and at a generally perpendicular angle to, the outer perimeter surface 26 of the substrate 12. Further, the reduced dimension circumferential portion 22 is formed with a circumferential wall 28 which extends at an angle from the top surface 24 of the substrate 12 to the shoulder 30. In manufacture of the cutting element 10, for example, a frustoconically-shaped spacer may be positioned over the superabrasive material (e.g., grit) to form a superabrasive table 14 having an upper superabrasive layer 34 positioned across the top surface 24 of the substrate 12, an annular portion 36 positioned about the reduced dimension circumferential portion 22 of the substrate 12 and a sloped outer perimeter surface 45.

Figure 8:
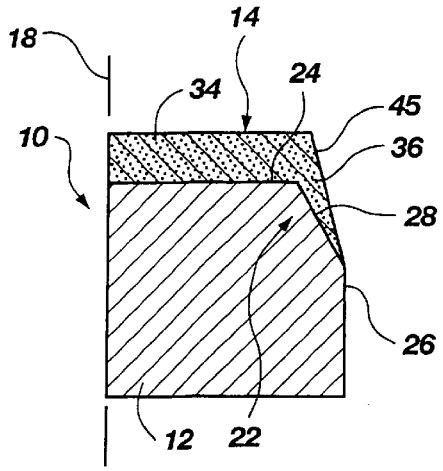
FIG. 8 is a longitudinal cross section of one half of a sixth embodiment of the cutting element of the present invention.

In a sixth embodiment of the cutting element 10 of the present invention illustrated in FIG. 8, the substrate is configured with a reduced dimension circumferential portion 22 which comprises a circumferential wall 28 extending from the top surface 24 of the substrate at an outward angle toward the outer perimeter surface 26 of the substrate 12, thereby providing a sloped circumferential wall 28 which terminates at the outer perimeter surface 26 of the substrate 12. In manufacturing the cutting element 10, the superabrasive table 14 is formed with an upper superabrasive layer 34 extending across the top surface 24 of the substrate 12 and with an annular portion 36 extending about the reduced dimension circumferential portion 22. The superabrasive table 14 may further be formed with a sloping outer perimeter surface 45 as illustrated.

Figure 9:
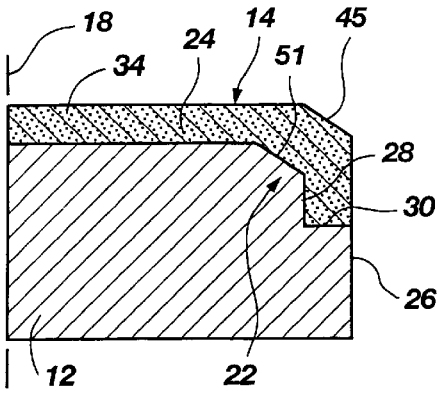
FIG. 9 is a longitudinal cross section of one half of a seventh embodiment of the cutting element of the present invention where the substrate is modified to provide a reduced dimension circumferential portion having a sloped edge.

FIG. 9 illustrates a seventh embodiment of the invention, which is similar to the embodiment shown in FIG. 1, except that the substrate 12 is configured with a reduced dimension circumferential portion 22 which is a hybrid between a frustoconical shape and a cylindrical shape as previously illustrated. That is, the substrate 12 is configured with a shoulder 30 which extends inwardly at substantially a perpendicular angle to the outer perimeter surface 26 of the substrate 12 and with an inner circumferential wall 28 which is substantially parallel in orientation to the outer perimeter surface 26. The substrate 12 is further configured with an outwardly sloping surface 51 which extends from the top surface 24 of the substrate 12 to intersect with the inner circumferential wall 28. In this embodiment, the superabrasive table 14 may also be configured with an outward-sloping outer sloping perimeter surface 45.

Figure 11:
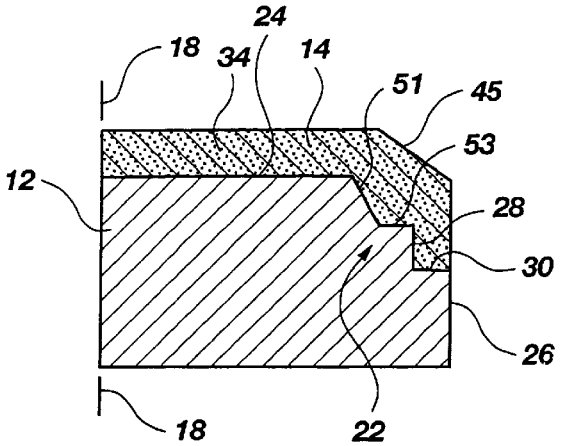
FIG. 11 is a longitudinal cross section of a ninth embodiment of the cutting element of the present invention where the substrate is manufactured with a combined frustoconical and cylindrical profile and the superabrasive table is frustoconically shaped.

A further modified substrate 12 is illustrated in an eighth embodiment of the invention shown in FIG. 10 where the reduced dimension circumferential portion 22 is configured with a first shoulder 30 which extends inwardly at a substantially perpendicular angle to the outer perimeter surface 26 of the substrate 12. An inner circumferential wall 28 extends upwardly from the shoulder 30 and is oriented substantially parallel to the outer perimeter surface 26 of the substrate 12. A second shoulder 53 extends inwardly from the inner circumferential wall 28 and at a substantially perpendicular orientation to the outer perimeter surface 26 of the substrate 12, and an outwardly sloping surface 51 extends from the top surface 24 of the substrate 12 to intersect with the second shoulder 53. As shown in FIG. 10, the superabrasive table 14 may be formed to the substrate 12 in a manner which provides a cylindrical cutting element 10. Alternatively, as shown in FIG. 11, ninth embodiment the superabrasive table 14 may be modified to have an outer sloping perimeter surface 45.

Figure 12:
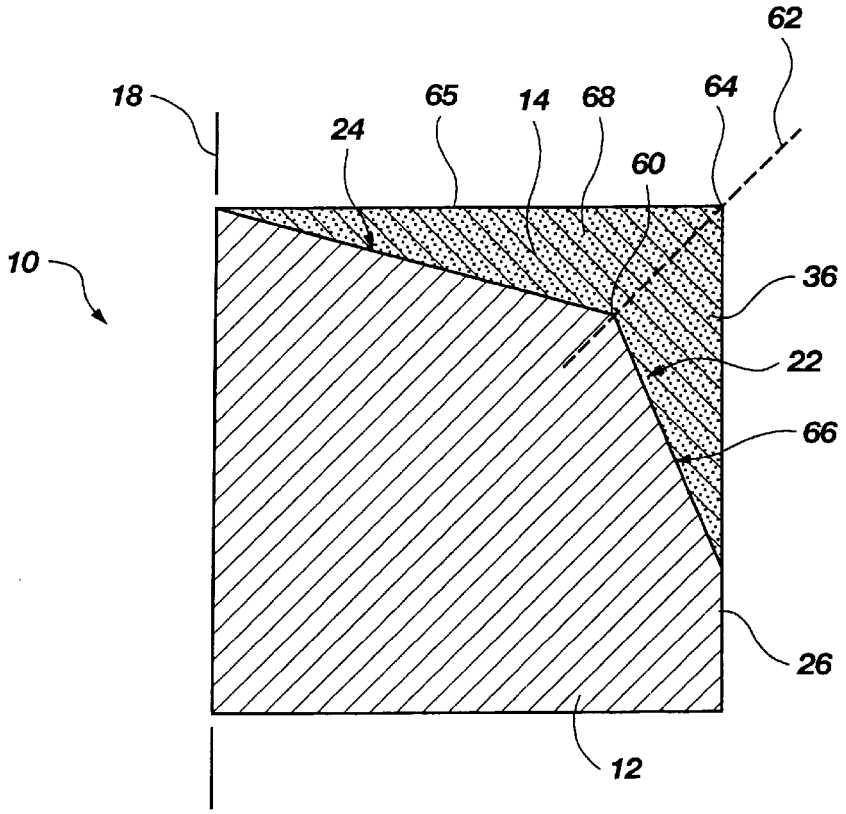
FIG. 12 is a longitudinal cross section of one half of a tenth embodiment of the cutting element of the present invention where the substrate is formed with a sloping face to contact an angled annular portion of the superabrasive member.

FIG. 12 illustrates a tenth embodiment of the invention where the top surface 24 of the substrate 12 is modified to slope radially outwardly and downwardly from the center axis 18 of the cutting element 10 toward the outer perimeter surface 26 of the substrate 12. The top surface 24 of the substrate 12 extends from at or near the center axis 18 to a point 60 defined by the intersection of the sloped top surface 24 of the substrate 12 with a line 62 extending through the outer perimeter edge 64 of the cutting element at about a 45° angle to the cylindrical outer perimeter surface 26 of the substrate 12. The outer perimeter edge 64 is defined by the intersection of the outer perimeter surface 26 with the top surface 65 of the superabrasive table 14. The reduced dimension circumferential portion 22 of the substrate 12 is then formed by reducing the outer circumference of the substrate 12 along a sloped line extending from the intersection point 60 to the outer perimeter surface 26 of the substrate 12. The reduced dimension circumferential portion 22 of the cutting element 10, therefore, presents a sloping face 66 against which the annular portion 36 of the superabrasive material is positioned. Thus, in an exemplary manufacturing of the cutting element 10 shown in FIG. 12, the superabrasive material (grit) positioned on the modified substrate 12 held in a cartridge is subjected to an HTHP process which causes the formation of a superabrasive table 14 comprising an upper superabrasive layer 68, which extends along the sloped top surface 24 of the substrate 12, and an annular ring or skirt-like portion 36 which extends downwardly and around the reduced dimension circumferential portion 22 of the substrate 12.

Figure 13:
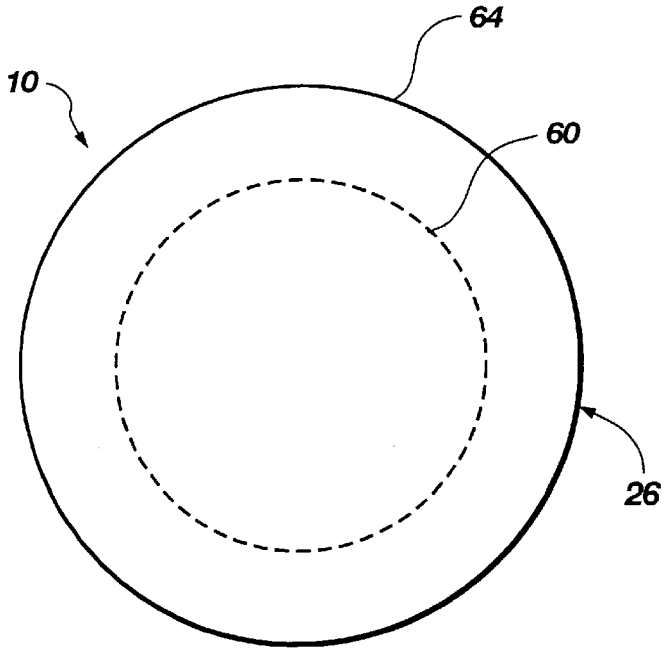
FIG. 13 is a plan view of the embodiment shown in FIG. 12 showing in phantom the outer edge of the reduced circumferential portion of the substrate.

The angle of slope of the top surface 24 from at or near the center axis 18 to the intersection point 60 may vary, as may the angle of slope of the sloping face 66 of the reduced dimension circumferential portion 22. Additionally, the line 62 may vary from the illustrated 45°, and may range from about 20° to about 70° as measured from the outer perimeter surface 26. The substrate 12 may be configured so that the upper superabrasive layer 68 is approximately symmetrical to the annular portion 36 of the superabrasive table 14 about the intersection line 62. With variation in the sloping configuration of the substrate 12, the intersection point 60, which also defines the upper circumferential edge of the substrate 12, may vary in its proximity to the outer perimeter edge 64 of the cutting element 10, as shown in FIG. 13.

Figure 14:
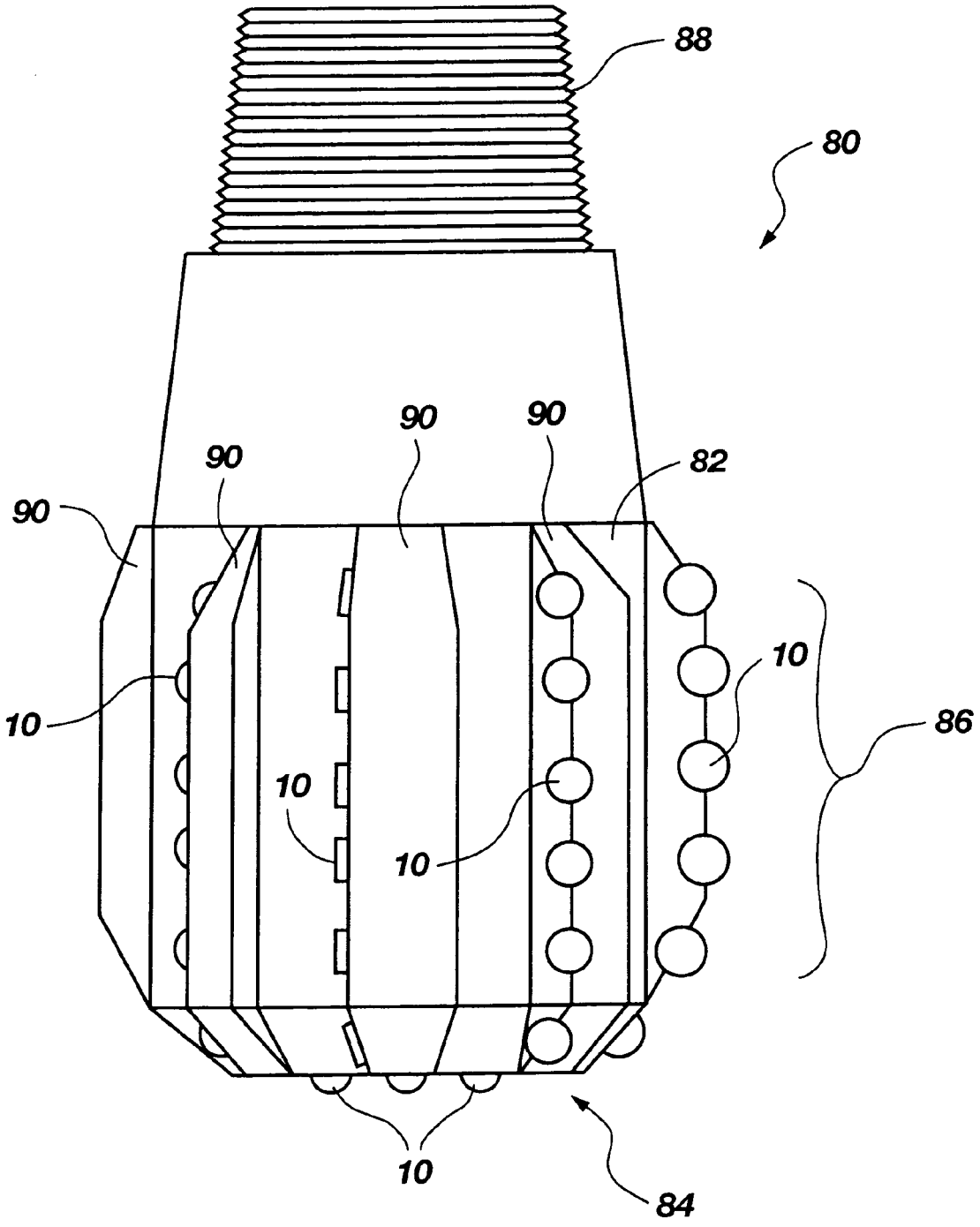
FIG. 14 is a view in elevation of a drill bit having cutting elements of the present invention attached.

The cutting element 10 of the present invention is illustrated in FIGS. 1–13 as being generally cylindrical, but it is understood that other configurations or geometries may be equally suitable for carrying out the invention, and may be more suitable in some types or configurations of drill bits. For example, the cutting element of the present invention may be cylindrical, rectangular, square, polygonal, oval or any other conceivable shape. The cutting element of the present invention may by employed in any number of different types and configurations of drill bits including, but not limited to, a rotary drill bit 80 as shown in FIG. 14. The rotary drill bit 80 may typically comprise a bit body 82 having a cutting portion 84 for cutting the bottom of a well bore and a gage portion 86 defining the circumferential dimension of the well bore, and may be connected to a shank 88 for attachment of the bit body 82 to a drill string. The cutting elements 10 may be formed in, or otherwise secured to, the bit body 82, as is illustrated in the cutting portion 84 of the drill bit 80, or the cutting elements may be attached to a structural element of the bit body 82, such as a blade 90 or other similar projection from the bit body 82 which serves to position the cutting elements 10 to contact the earth formation.

The cutting element of the present invention is particularly structured to increase the amount of superabrasive material, such as sintered diamond, positioned at or near the perimeter of the cutting element, and to arrange the superabrasive and substrate materials in such a way that a ring of superabrasive material always circumscribes a ring or body of substrate material, with optional repetition of that configuration, to effectively reduce tensile stress existing in the superabrasive table and to produce a cutting element with improved durability characteristics. The substrate of the cutting element may be modified in any number of ways to accomplish the stated objective. Hence, reference herein to specific details of the illustrated embodiments is by way of example and not by way of limitation. It will be apparent to those skilled in the art that many additions, deletions and modifications to the illustrated embodiments of the invention may be made without departing from the spirit and scope of the invention as defined by the following claims.

What is claimed is:

1. A superabrasive cutting element for use in an earth boring drill bit, comprising:

a generally cylindrically shaped substrate defined by a generally planar top surface of a preselected circumferential dimension, an outer perimeter surface having a preselected circumferential dimension greater than the preselected circumferential dimension of the top surface, and a sloped circumferential wall extending downwardly and outwardly from the top surface and terminating at the outer perimeter surface to form a reduced circumferential portion;

a superabrasive table formed to the top surface and to the sloped circumferential wall of the substrate, the superabrasive table having an upper superabrasive layer disposed across the top surface of the substrate and an annular portion of the superabrasive layer disposed around the sloped circumferential wall; and the superabrasive table further having an outer perimeter surface extending only downwardly and outwardly from the upper superabrasive layer at a predetermined slope and terminating at the outer perimeter surface of the substrate.

2. The superabrasive cutting element of claim 1, further comprising:

a full-circumference shoulder projecting generally perpendicular inwardly from the outer perimeter surface of the substrate and wherein the sloped circumferential wall of the substrate extends to the shoulder and terminates short of the outer perimeter surface of the substrate.

3. The superabrasive cutting element of claim 2, wherein:

the sloped circumferential wall has an outwardly sloping surface extending from the top surface of the substrate for a predetermined distance before inner circumferential wall extends generally parallel to the outer perimeter surface of the substrate prior to terminating at the shoulder and short of the outer perimeter surface of the substrate; and the sloping outer perimeter surface of the superabrasive table extending from the upper superabrasive layer a predetermined distance prior to intersecting an additional outer perimeter surface of the superabrasive table, the additional outer perimeter surface of the superabrasive table extending a predetermined distance downwardly from the intersection of the sloping outer perimeter surface of the superabrasive table and being generally aligned with and terminating at the outer perimeter surface of the substrate.

4. The superabrasive cutting element of claim 3, further comprising:

a second shoulder being generally perpendicular to the outer perimeter surface of the substrate and being interposed between the outwardly sloping surface extending from the top surface of the substrate and the inner circumferential wall which extends generally parallel to the outer perimeter surface of the substrate prior to terminating at the first shoulder and short of the outer perimeter surface of the substrate.

5. The superabrasive cutting element of claim 1, further comprising:

an inwardly angled rim extending from the outer perimeter surface of the substrate further defining the substrate, and the sloping outer perimeter surface of the superabrasive table extending to the rim and short of the outer perimeter surface of the substrate;

a full-circumference shoulder projecting generally horizontally inwardly from the inwardly angled rim; and wherein the sloped inner circumferential wall of the substrate extends to the shoulder and terminates short of the outer perimeter surface of the substrate.

6. The superabrasive cutting element of claim 1, wherein the substrate and the superabrasive table have differing coefficients of thermal expansion and further wherein the coefficient of thermal expansion of the substrate is greater than the coefficient of thermal expansion of the superabrasive table.

7. A superabrasive cutting element for use in an earth boring drill bit, comprising:

a generally cylindrically shaped substrate defined by a generally planar top surface of a preselected circumferential dimension, an outer perimeter surface having a preselected circumferential dimension greater than the preselected circumferential dimension of the top surface, and a sloped circumferential wall extending downwardly and outwardly from the top surface and terminating at the outer perimeter surface to form a reduced circumferential portion;

a first shoulder projecting generally perpendicular inwardly from the outer perimeter surface and wherein the sloped circumferential wall of the substrate extends to the shoulder and terminates short of the outer perimeter surface;

a second shoulder being generally perpendicular to the outer perimeter surface of the substrate and being interposed between the outwardly sloping surface extending from the top surface of the substrate and inner circumferential wall which extends generally parallel to the outer perimeter surface of the substrate prior to terminating at the first shoulder and short of the outer perimeter surface of the substrate; and a superabrasive table formed to the top surface and to the sloped circumferential wall of the substrate, the superabrasive table having an upper superabrasive layer disposed across the top surface of the substrate and an annular portion of the superabrasive layer disposed around the sloped circumferential wall and extending not in excess of the circumferential dimension of the outer perimeter surface of the substrate.

8. The superabrasive cutting element of claim 7, wherein the substrate and the superabrasive table have differing coefficients of thermal expansion and further wherein the coefficient of thermal expansion of the substrate is greater than the coefficient of thermal expansion of the superabrasive table.

9. A superabrasive cutting element for use in an earth boring drill bit, comprising:

a generally cylindrically shaped substrate defined by a generally planar top surface of a preselected circumferential dimension, an outer perimeter surface having a preselected circumferential dimension greater than the preselected circumferential dimension of the top surface and wherein the top surface of the substrate is configured to slope radially outwardly and downwardly from a longitudinal centerline of the cutting element toward the outer perimeter surface to a point defined by the intersection of the sloped top surface with a line formed through the intersection at about a 45 degree angle to the perimeter surface of the substrate, and wherein a reduced dimension circumferential portion of the substrate is defined by a sloping face extending outwardly and downwardly from the point of intersection of the sloped top surface to the outer perimeter surface of the substrate; and a superabrasive table formed to the top surface and to the sloping face of the substrate, the superabrasive table having an upper superabrasive layer disposed across the top surface of the substrate and extending outwardly to an outer perimeter edge of the cutting element and an annular portion of the superabrasive layer disposed around the sloped face of the substrate and extending generally downwardly from the outer perimeter edge of the cutting element and terminating at the outer perimeter surface of the substrate.

10. The superabrasive cutting element of claim 9, wherein the substrate and the superabrasive table have differing coefficients of thermal expansion and further wherein the coefficient of thermal expansion of the substrate is greater than the coefficient of thermal expansion of the superabrasive table.

11. A drill bit for drilling an earth formation having at least one cutting element secured to a bit body, the at least one cutting element comprising:

a generally cylindrically shaped substrate defined by a generally planar top surface of a preselected circumferential dimension, an outer perimeter surface having a preselected circumferential dimension greater than the preselected circumferential dimension of the top surface, and a sloped circumferential wall extending downwardly and outwardly from the top surface and terminating at the outer perimeter surface to form a reduced circumferential portion;

a superabrasive table formed to the top surface and to the sloped circumferential wall of the substrate, the superabrasive table having an upper superabrasive layer disposed across the top surface of the substrate and an annular portion of the superabrasive layer disposed around the sloped circumferential wall; and the superabrasive table further having a sloping outer perimeter surface extending only downwardly and outwardly from the upper superabrasive layer and terminating at the outer perimeter surface of the substrate.

12. The drill bit of claim 11, wherein the at least one cutting element further comprises:

a full-circumference shoulder projecting generally perpendicular inwardly from the outer perimeter surface of the substrate and wherein the sloped circumferential wall of the substrate extends to the shoulder and terminates short of the outer perimeter surface of the substrate.

13. The drill bit of claim 12, wherein the at least one cutting element further comprises:

the sloped circumferential wall has an outwardly sloping surface extending from the top surface of the substrate for a predetermined distance before inner circumferential wall extends generally parallel to the outer perimeter surface prior to terminating at the shoulder and short of the outer perimeter surface of the substrate; and the sloping outer perimeter surface of the superabrasive table extending from the upper superabrasive layer a predetermined distance prior to intersecting an additional outer perimeter surface of the superabrasive table, the additional outer perimeter surface of the superabrasive table extending a predetermined distance downwardly from the intersection of the sloping outer perimeter surface of the superabrasive table and being generally aligned with and terminating at the outer perimeter surface of the substrate.

14. The drill bit of claim 13, wherein the at least one cutting element further comprises:

a second shoulder being generally perpendicular to the outer perimeter surface of the substrate and being interposed between the outwardly sloping surface extending from the top surface of the substrate and the inner circumferential wall which extends generally parallel to the outer perimeter surface of the substrate prior to terminating at the first shoulder and short of the outer perimeter surface of the substrate.

15. The drill bit of claim 11, wherein the at least one cutting element further comprises:

an inwardly angled rim extending from the outer perimeter surface of the substrate further defining the substrate, and the sloping outer perimeter surface of the superabrasive table extending thereto and short of the outer perimeter surface of the substrate;

a full-circumference shoulder projecting generally horizontally inwardly from the inwardly angled rim; and wherein the sloped inner circumferential wall of the substrate extends to the shoulder and terminates short of the outer perimeter surface.

16. The drill bit of claim 11, wherein the substrate and the superabrasive table of the at least one cutting element have differing coefficients of thermal expansion and further wherein the coefficient of thermal expansion of the substrate is greater than the coefficient of thermal expansion of the superabrasive table.

17. A drill bit for drilling an earth formation having at least one cutting element secured to a bit body, the at least one cutting element comprising:

a generally cylindrically shaped substrate defined by a generally planar top surface of a preselected circumferential dimension, an outer perimeter surface having a preselected circumferential dimension greater than the preselected circumferential dimension of the top surface, and a sloped circumferential wall extending downwardly and outwardly from the top surface and terminating at the outer perimeter surface to form a reduced circumferential portion;

a first shoulder projecting generally perpendicular inwardly from the outer perimeter surface and wherein the sloped circumferential wall of the substrate extends to the shoulder and terminates short of the outer perimeter surface of the substrate;

a second shoulder being generally perpendicular to the outer perimeter surface of the substrate and being interposed between the outwardly sloping surface extending from the top surface of the substrate and inner circumferential wall which extends generally parallel to the outer perimeter surface of the substrate prior to terminating at the first shoulder and short of the outer perimeter surface of the substrate; and a superabrasive table formed to the top surface and to the sloped circumferential wall of the substrate, the superabrasive table having an upper superabrasive layer disposed across the top surface of the substrate and an annular portion of the superabrasive layer disposed around the sloped circumferential wall and extending not in excess of the circumferential dimension of the outer perimeter surface of the substrate.

18. The drill bit of claim 17, wherein the substrate and the superabrasive table of the at least one cutting element have differing coefficients of thermal expansion and further wherein the coefficient of thermal expansion of the substrate is greater than the coefficient of thermal expansion of the superabrasive table.

19. A drill bit for drilling an earth formation having at least one cutting element secured to a bit body, the at least one cutting element comprising:

a generally cylindrically shaped substrate defined by a generally planar top surface of a preselected circumferential dimension, an outer perimeter surface having a preselected circumferential dimension greater than the preselected circumferential dimension of the top surface and wherein the top surface of the substrate is configured to slope radially outwardly and downwardly from a longitudinal centerline of the cutting element toward the outer perimeter surface to a point defined by the intersection of the sloped top surface with a line formed through the intersection at about a 45 degree angle to the perimeter surface of the substrate, and wherein a reduced dimension circumferential portion of the substrate is defined by a sloping face extending outwardly and downwardly from the point of intersection of the sloped top surface to the outer perimeter surface of the substrate; and a superabrasive table formed to the top surface and to the sloping face of the substrate, the superabrasive table having an upper superabrasive layer disposed across the top surface of the substrate and extending outwardly to an outer perimeter edge of the cutting element and an annular portion of the superabrasive layer disposed around the sloped face of the substrate and extending generally downwardly from the outer perimeter edge of the cutting element and terminating at the outer perimeter surface of the substrate.

20. The drill bit of claim 19, wherein the substrate and the superabrasive table of the at least one cutting element have differing coefficients of thermal expansion and further wherein the coefficient of thermal expansion of the substrate is greater than the coefficient of thermal expansion of the superabrasive table.

* * * * *

UNITED STATES PATENT AND TRADEMARK OFFICE

CERTIFICATE OF CORRECTION

PATENT NO. : 5,971,087
DATED : October 26, 1999
INVENTOR(S) : Arthur A. Chaves

It is certified that error appears in the above-identified patent and that said Letters Patent is hereby corrected as shown below:

Title page,
Item [56], References Cited, change "Murewicz et al." to -- Jurewicz et al. --

Drawings,
FIG. 1, delete reference numeral "42"

Column 1,
Line 32, change "resistance" to -- resistant --

Column 5,
Line 13, change "(superabrasive table)" to -- "superabrasive table" --

Figure 15:
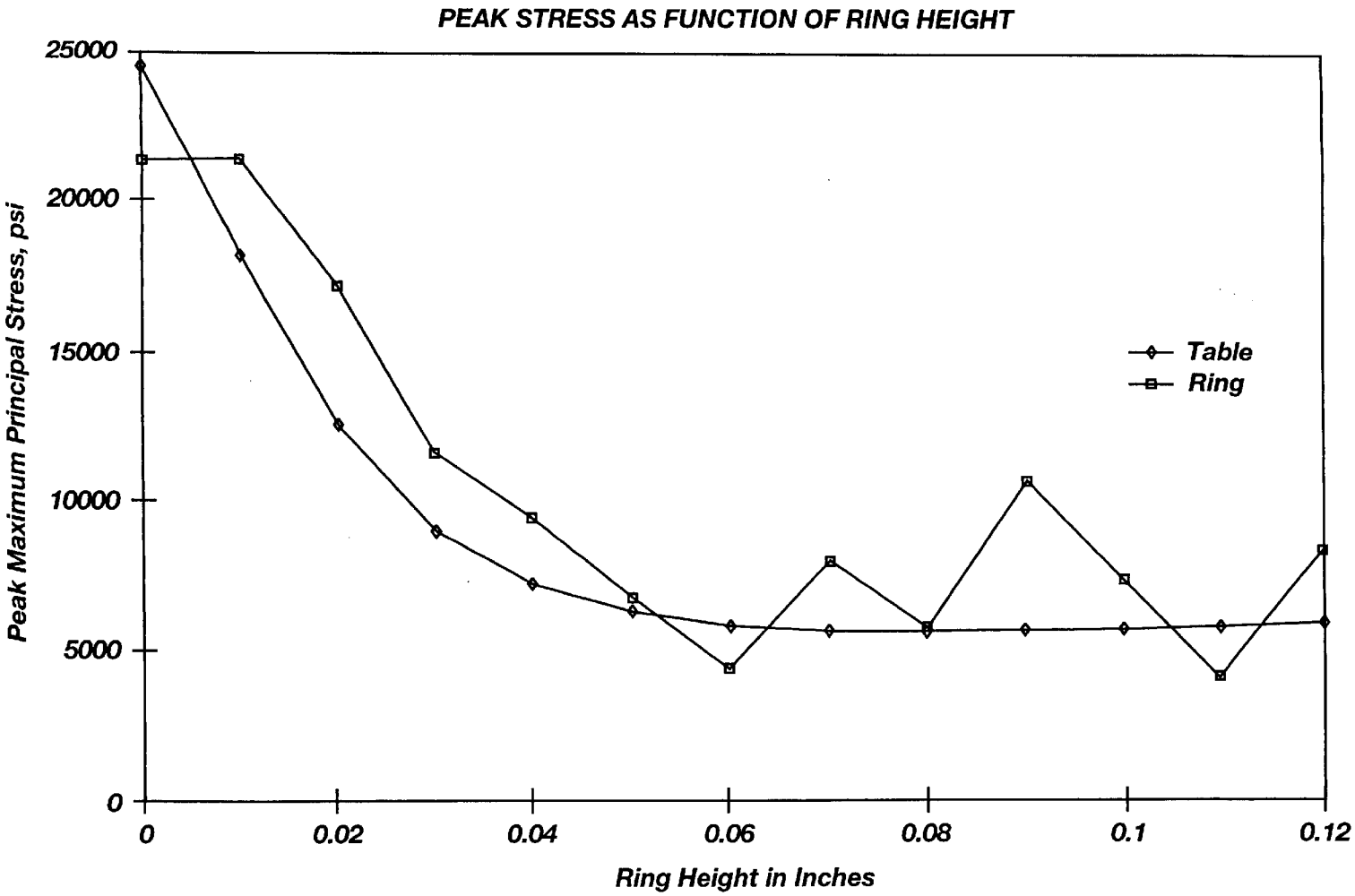
FIG. 15 is a graph illustrating the reduction of tensile stresses in the superabrasive cutting element as a function of the depth dimension of the annular portion of superabrasive material.

Column 6,
Line 6, change "distance" to -- depth --
Line 8, change "FIG. 10" to -- FIG. 15 --
Line 20, delete "or"
Line 30, delete "cutting element 10" and insert -- substrate 12 -- therefor
Line 35, change "HTBP" to -- HTHP --

Column 8,
Line 2, delete "outward"
Line 3, delete "sloping" (first occurrence)
Line 20, after "embodiment" insert -- , --

Column 9,
Line 66, change "perpendicular" to -- perpendicularly --

Column 10,
Line 8, after "before" change "inner" to -- the sloped --
Line 14, change "extending" to -- extends --
Line 29, before "circumferential" change "inner" to -- sloped --
Line 31, delete "first" and insert -- full-circumference -- therefor
Line 42, delete "inner"
Line 62, change "perpendicular" to -- perpendicularly --
Line 65, after "to the" insert -- first --

Column 11,
Line 3, delete "outwardly sloping surface" and insert -- sloped circumferential wall -- therefor
Line 5, before "inner" insert -- an --
Line 15, after "excess of the" insert --preselected --

UNITED STATES PATENT AND TRADEMARK OFFICE

CERTIFICATE OF CORRECTION

PATENT NO. : 5,971,087
DATED : October 26, 1999
INVENTOR(S) : Arthur A. Chaves

It is certified that error appears in the above-identified patent and that said Letters Patent is hereby corrected as shown below:

Column 11 (con't),
Line 34, change "the" (first occurrence) to -- an --
Line 48, change "sloped" to -- sloping --

Column 12,
Line 16, change "perpendicular" to -- perpendicularly --
Line 23, change "has" to -- having --
Line 25, after "before" insert -- an --
Line 35, after "from" change "the" to -- an --
Line 36, after "table" insert -- and the additional outer perimeter surface --
Line 47, delete "first" and insert -- full-circumference --
Line 58, delete "inner"

Column 13,
Line 13, change "perpendicular" to -- perpendicularly --
Line 16, after "to the" insert -- first --
Line 20, delete "outwardly sloping surface" and insert -- sloped circumferential wall -- therefor
Line 22, before "inner" insert -- an --
Line 32, after "excess of the" insert -- preselected -- change "the" (first occurrence) before "intersection" to -- an --

Column 14,
Line 13, change "the" (first occurrence) before "intersection" to -- an --
Line 15, after "to the" insert -- outer --
Line 27, change "sloped" to -- sloping --

Signed and Sealed this

Thirtieth Day of July, 2002

*Attest:*

*Attesting Officer*

JAMES E. ROGAN
*Director of the United States Patent and Trademark Office*